US005447137A

United States Patent [19]

Asano et al.

[11] Patent Number: 5,447,137

[45] Date of Patent: Sep. 5, 1995

[54] LEAN BURN CONTROL METHOD AND DEVICE FOR INTERNAL COMBUSTION ENGINE AND FUEL INJECTION QUANTITY CONTROL METHOD AND DEVICE INCLUDING SAME

[75] Inventors: Seiji Asano; Takeshi Atago, both of Katsuta; Nobuo Kurihara, Hitachioota, all of Japan

[73] Assignee: Hitachi, Ltd., Tokyo, Japan

[21] Appl. No.: 128,137

[22] Filed: Sep. 29, 1993

[30] Foreign Application Priority Data

Oct. 2, 1992 [JP] Japan ..... 4-264610

[51] Int. Cl.[6] ..... F02D 41/00

[52] U.S. Cl. ..... 123/436; 123/682

[58] Field of Search ..... 123/419, 435, 436, 682

[56] References Cited

U.S. PATENT DOCUMENTS

| | | | |
|---|---|---|---|
| 4,271,798 | 6/1981 | Seitz et al. | 123/436 X |
| 4,327,689 | 5/1982 | Rachel | 123/436 |
| 4,434,768 | 3/1984 | Ninomiya | 123/436 |
| 4,776,312 | 10/1988 | Yoshioka et al. | 123/436 |

FOREIGN PATENT DOCUMENTS

| | | | |
|---|---|---|---|
| 222940 | 12/1983 | Japan | 123/436 |
| 3445 | 1/1985 | Japan | 123/436 |
| 61-229936 | 10/1986 | Japan . | |

*Primary Examiner*—Tony M. Argenbright
*Attorney, Agent, or Firm*—Evenson, McKeown, Edwards & Lenahan

[57] ABSTRACT

A control device for an internal combustion engine capable of conducting lean burn control, such as exhaust gas emission control, always optimally regardless of a timewise change of the internal combustion engine, variations in engines, and an environmental change. The control device includes a detector for detecting a burn condition of the internal combustion engine, a lean limit air-fuel ratio factor map, a lean burn feedback logic, an oxygen concentration sensor, and a feedback control logic for controlling an air-fuel ratio to a theoretical air-fuel ratio, wherein lean burn is performed at the middle point between the lean limit air-fuel ratio and the theoretical air-fuel ratio.

26 Claims, 13 Drawing Sheets

FIG. 13
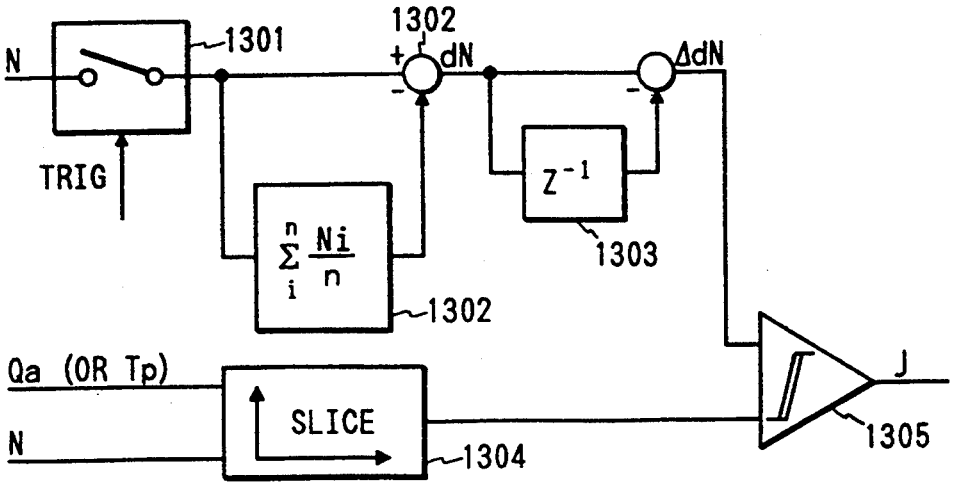
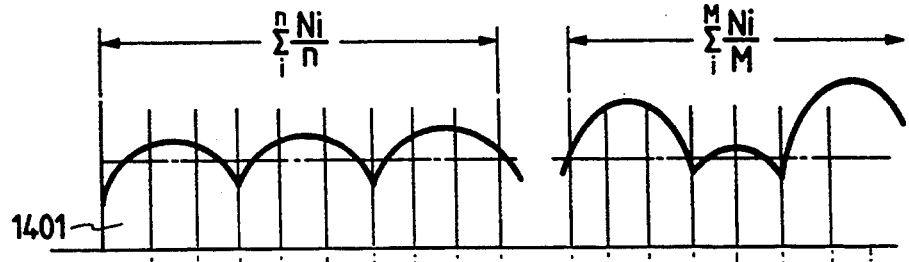
FIG. 14A
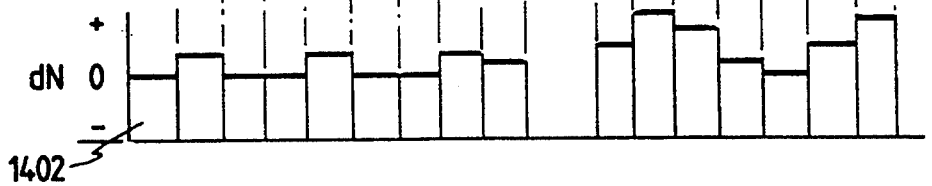
FIG. 14B
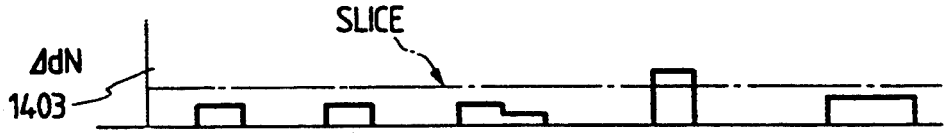
FIG. 14C
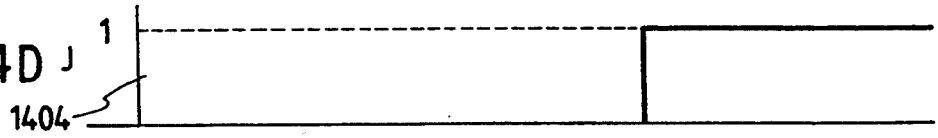
FIG. 14D FIG. 16
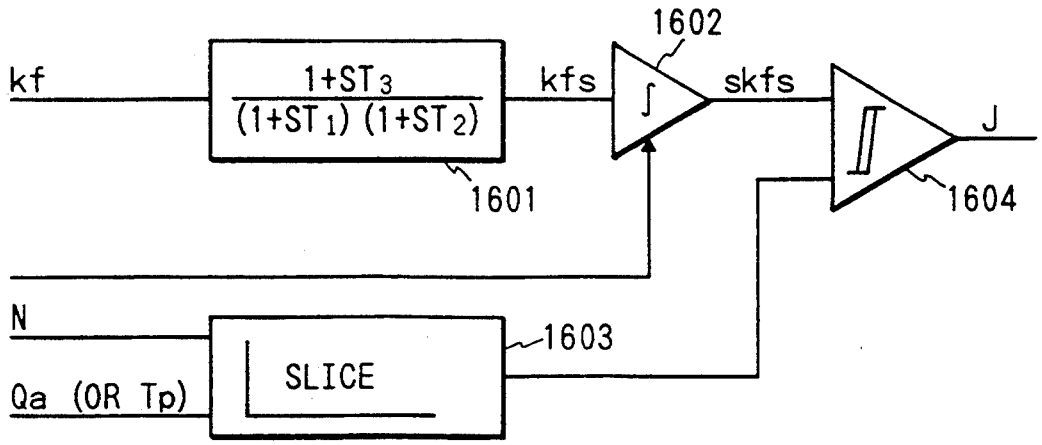
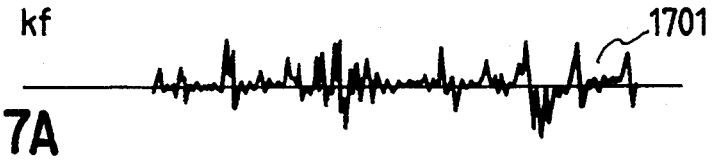
FIG.17A
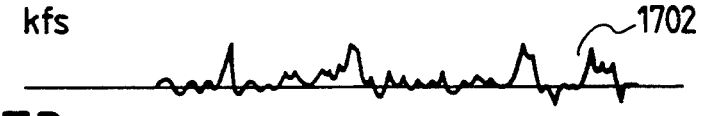
FIG.17B
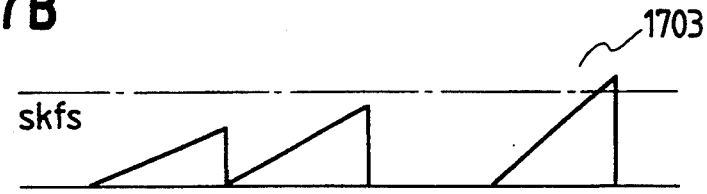
FIG.17C

LEAN BURN CONTROL METHOD AND DEVICE FOR INTERNAL COMBUSTION ENGINE AND FUEL INJECTION QUANTITY CONTROL METHOD AND DEVICE INCLUDING SAME

BACKGROUND OF THE INVENTION

The present invention relates to a lean burn control method and device for an internal combustion engine, and a fuel injection quantity control method and device including the lean burn control method and device. In particular, the present invention relates to a lean burn control method and device for an internal combustion engine to be controlled so that lean burn is performed at the middle point between a theoretical air-fuel ratio and a lean burn limit, and a fuel injection quantity control method and device including such a lean burn control method and device.

As a control method for lean burn, there has conventionally been considered two methods. One of the two methods is a method using a sensor called a wide-range $O_2$ sensor, which can generate a detection signal proportional to an oxygen concentration. The other method is a method such that it is decided whether or not an air-fuel ratio has entered a roughness (rotation fluctuation) zone, and that a fuel quantity is increased if the air-fuel ratio has entered the roughness zone.

The method using the wide-range $O_2$ sensor requires an expensive $O_2$ sensor to cause an unavoidable increase in cost.

In general, it is known that an air-fuel ratio zone where a $NO_x$ catalyst works most is present at the middle position between a theoretical air-fuel ratio and a roughness air-fuel ratio zone, and that the rate of purification of the $NO_x$ catalyst decreases in the vicinity of the roughness air-fuel ratio zone (see FIG. 3). That is, in the method such that burning is carried out until the air-fuel ratio has just entered the roughness zone, and that a fuel quantity is somewhat increased to restore the air-fuel ratio (reduce the air-fuel ratio), so as to improve the burning, there occurs a problem that an emission quantity of an exhaust gas such as $NO_x$ increases.

Further, in an air-fuel ratio control device for a multi-cylinder engine for controlling an air-fuel ratio of an air-fuel mixture to be supplied to each cylinder to a roughness tolerance limit on the lean side according to an output from burn condition detecting means for detecting a burn condition in each cylinder, it is known to provide acceleration detecting means for detecting acceleration of the engine and control means for controlling a fuel supply quantity at acceleration of the engine according to an output from the acceleration detecting means in such a manner that the smaller the roughness tolerance limit on the lean side in each cylinder, the more the fuel supply quantity is increased (e.g., Japanese Patent Laid-open Publication No. 61-229936).

In this case, however, it is considered that an optimum lean burn air-fuel ratio is present at the middle point between a theoretical air-fuel ratio and a lean burn limit (i.e., the roughness tolerance limit mentioned in the above prior art) from the two viewpoints of emission of an exhaust gas (especially, $NO_x$) from the internal combustion engine and stable lean burn of the internal combustion engine. Accordingly, the increase in the fuel quantity from the roughness tolerance limit to the fuel-rich air-fuel ratio according to only the output from the burn condition detecting means cause a deterioration in emission.

SUMMARY OF THE INVENTION

It is accordingly an object of the present invention to provide a lean burn control method and device for an internal combustion engine which can effect lean burn at the middle point between the theoretical air-fuel ratio and the lean burn limit to prevent the deterioration in emission, obtain a stable output torque of the internal combustion engine, and improve a fuel consumption.

According to an aspect of the present invention, there is provided a lean burn control device for an internal combustion engine, comprising means for detecting a burn condition of said internal combustion engine; means for computing an internal condition variable representing a burn degree from an output from said means for detecting said burn condition; an oxygen concentration sensor provided in an exhaust pipe of said internal combustion engine for detecting an oxygen concentration in an exhaust gas; means for computing a first fuel quantity to be supplied to said internal combustion engine according to an output from said oxygen concentration sensor to control an air-fuel ratio to a theoretical air-fuel ratio; means for computing a second fuel quantity to be supplied to said internal combustion engine-according to said internal condition variable representing said burn degree and an internal condition variable representing said theoretical air-fuel ratio; means for detecting one of a transition state and a steady state of said internal combustion engine; means for selecting one of said first fuel quantity and said second fuel quantity according to an output from said means for detecting one of said transition state and said steady state; means for detecting a rotational speed of said internal combustion engine; and means for detecting an air quantity to be sucked into said internal combustion engine.

According to another aspect of the present invention, there is provided a lean burn control device for an internal combustion engine, comprising a lean burn limit map preliminarily stored; an oxygen concentration sensor provided in an exhaust pipe of said internal combustion engine for detecting an oxygen concentration in an exhaust gas; means for computing a first fuel quantity to be supplied to said internal combustion engine according to an output from said oxygen concentration sensor to control an air-fuel ratio to a theoretical air-fuel ratio; means for computing a second fuel quantity to be supplied to said internal combustion engine according to a constant retrieved from said lean burn limit map according to a condition of said internal combustion engine and an internal condition variable representing said theoretical air-fuel ratio; means for detecting one of a transition state and a steady state of said internal combustion engine; means for selecting one of said first fuel quantity and said second fuel quantity according to an output from said means for detecting one of said transition state and said steady state; means for detecting a rotational speed of said internal combustion engine; and means for detecting an air quantity to be sucked into said internal combustion engine.

According to a further aspect of the present invention, there is provided a fuel injection quantity control device for an internal combustion engine, comprising means for detecting a burn condition of said internal combustion engine; means for computing an internal condition variable representing a burn degree from an output from said means for detecting said burn condition; an oxygen concentration sensor provided in an exhaust pipe of said internal combustion engine for detecting an oxygen concentration in an exhaust gas; means for computing a first fuel quantity to be supplied to said internal combustion engine according to an output from said oxygen concentration sensor to control an air-fuel ratio to a theoretical air-fuel ratio; means for computing a second fuel quantity to be supplied to said internal combustion engine according to said internal condition variable representing said burn degree and an internal condition variable representing said theoretical air-fuel ratio; means for detecting one of a transition state and a steady state of said internal combustion engine; means for selecting one of said first fuel quantity and said second fuel quantity according to an output from said means for detecting one of said transition state and said steady state; means for detecting a rotational speed of said internal combustion engine; means for detecting an air quantity to be sucked into said internal combustion engine; a fuel injector; and means for computing a fuel injection quantity to be injected from said fuel injector into said internal combustion engine according to an output from said means for detecting said rotational speed of said internal combustion engine and an output from said means for detecting said air quantity to be sucked into said internal combustion engine, The first fuel quantity to be supplied to the internal combustion engine is computed according to an output from the oxygen concentration sensor to thereby control an air-fuel ratio to a theoretical air-fuel ratio. On the other hand, a lean burn limit of the internal combustion engine is detected by the burn condition detecting means, and the second fuel quantity to be supplied to the internal combustion engine is computed according to the lean burn limit detected. Further, one of the first fuel quantity and the second fuel quantity is selected according to a result of decision whether the internal combustion engine is in a transition state or a steady state. Thus, lean burn control is performed at the middle point between the theoretical air-fuel ratio and the lean burn limit.

Other objects and features of the invention will be more fully understood from the following detailed description and appended claims when taken with the accompanying drawings.

BRIEF DESCRIPTION OF THE DRAWINGS

FIG. 13 is a control block diagram similar to FIG. 11, showing another preferred embodiment using an engine rotation angular velocity for the detection of a burn condition;

FIG. 14 is a timing chart showing the operation of the preferred embodiment shown in FIG. 13;

FIG. 16 is a control block diagram similar to FIG. 13, showing another preferred embodiment using an output from an engine oscillation sensor for the detection of a burn condition; and FIG. 17 is a timing chart showing the operation of the preferred embodiment shown in FIG. 16.

DETAILED DESCRIPTION OF THE PREFERRED EMBODIMENTS

There will now be described some preferred embodiments of the present invention with reference to the accompanying drawings.

Figure 1:
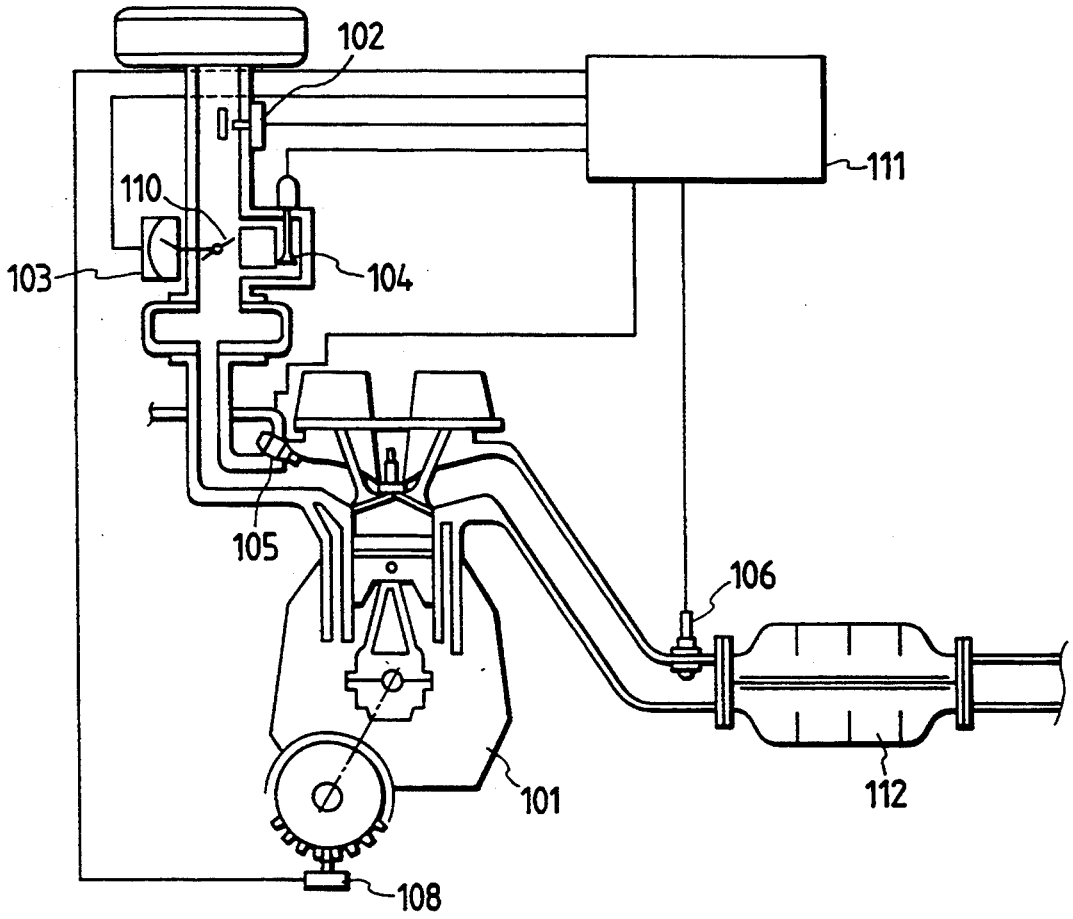
FIG. 1 is a schematic diagram showing a general construction of a lean burn control device for an internal combustion engine according to the present invention.

FIG. 1 shows a general construction of a system including a preferred embodiment of the present invention. Referring to FIG. 1, reference numeral 101 designates an internal combustion engine. A suction system of the internal combustion engine 101 is provided with a throttle valve 110 for controlling an air quantity to be sucked by the internal combustion engine 101. An opening angle of the throttle valve 110 is detected by a throttle opening sensor 103. A thermal air flow meter 102 for measuring a mass flow of the suction air is provided upstream of the throttle valve 110. Further, the suction system is provided with an idle speed control (ISC) valve 104 for controlling an air flow bypassing the throttle valve 110 to thereby control an idling speed of the internal combustion engine 101.

A fuel injection valve 105 for supplying fuel to the internal combustion engine 101 is provided at a suction port connected with each cylinder of the internal combustion engine 101. A crank angle sensor 108 for detecting a rotational speed of the internal combustion engine 101 is provided near a crankshaft.

An exhaust system of the internal combustion engine 101 is provided with a nitrogen oxides reduction catalyst 112 for purifying an exhaust gas by nitrogen oxides reduction. An oxygen concentration sensor 106 for detecting an oxygen concentration in the exhaust gas is provided upstream of the nitrogen oxides reduction catalyst 112.

The internal combustion engine 101 is generally controlled by an internal combustion engine control unit 111 for detecting an operational condition of the internal combustion engine 101 according to output signals from the various sensors mentioned above, calculating a fuel quantity required by the internal combustion engine 101 from the sensor signals in a predetermined procedure, and driving actuators for the fuel injection valves 105, etc. In this preferred embodiment, the oxygen concentration sensor 106 is a sensor adapted to output a binary signal with reference to a threshold of an air-fuel ratio.

Figure 2:
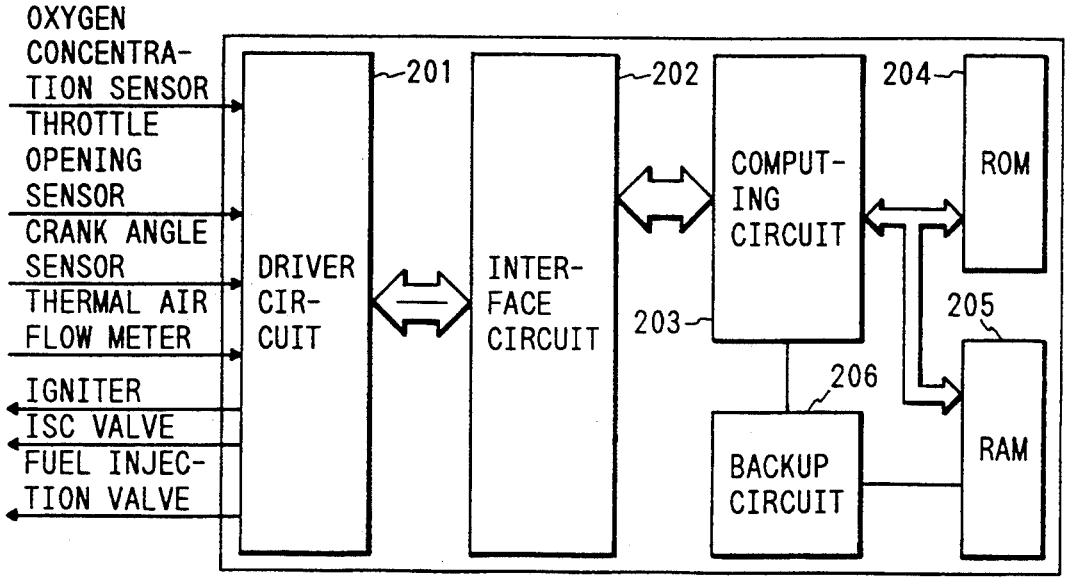
FIG. 2 is a functional block diagram of the lean burn control device according to the present invention.

FIG. 2 shows an internal circuit block of the internal combustion engine control unit 111. The internal circuit block includes a driver circuit 201 for inputting the output signals from the various sensors and converting low-intensity signals into high-intensity signals for driving the actuators, an input/output circuit (interface circuit) 202 for converting input/output signals into analog/digital signals for digital computing, a computing circuit 203 having a microcomputer or an equivalent computing circuit, a nonvolatile ROM 204 and a volatile RAM 205 for storing constants, variables, and programs to be used for the operation of the computing circuit 203, and a backup circuit 206 for holding the contents in the volatile RAM 205. In this preferred embodiment, the output signals from the oxygen concentration sensor 106, the throttle opening sensor 104, the crank angle sensor 108 and the thermal air flow meter 102 are input into the internal combustion engine control unit 111, and an ignition signal, an ISC valve control signal and a fuel injection valve driving signal are output from the internal combustion engine control unit 111.

Figure 3:
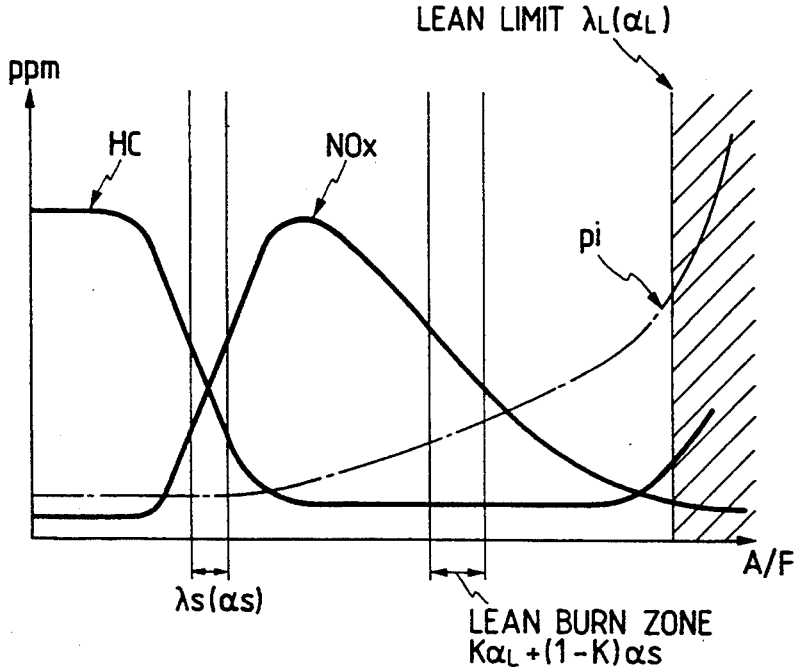
FIG. 3 is a graph showing the relation between an air-fuel ratio, an output shaft fluctuation torque, an emission, and a lean limit zone in the internal combustion engine.

FIG. 3 shows the relation between an air-fuel ratio of the internal combustion engine 101, a hydrocarbon (HC) concentration in the exhaust gas, a nitrogen oxides ($NO_x$) concentration, and an output shaft fluctuation torque. A zone shown by $\lambda_S$ is a theoretical air-fuel ratio zone to be controlled in a general internal combustion engine. Further, a hatched zone is a zone where misfire occurs or a surge torque increases to cause no fit for practical use when an internal combustion engine is in a lean burn condition, and a lower limit (lean limit) of an air-fuel ratio in this zone is shown by $\lambda_L$.

When lean burn is effected in the internal combustion engine with use of the nitrogen oxides reduction catalyst, it is ideal to perform fuel control at the middle point between the theoretical air-fuel ratio $\lambda_S$ and the lean limit $\lambda_L$ from the two viewpoints of an output shaft fluctuation torque and a nitrogen oxides reduction efficiency. A lean burn zone is the weighted mean of the theoretical air-fuel ratio $\lambda_S$ and the lean limit $\lambda_L$. The lean limit $\lambda_L$ and a weighted mean constant K are expressed as the following functions.

$$\lambda_L = f(dN, Pi) \quad (1\text{-}1)$$

$$K = g(dN, Pi) \quad (1\text{-}2)$$

Figure 4:
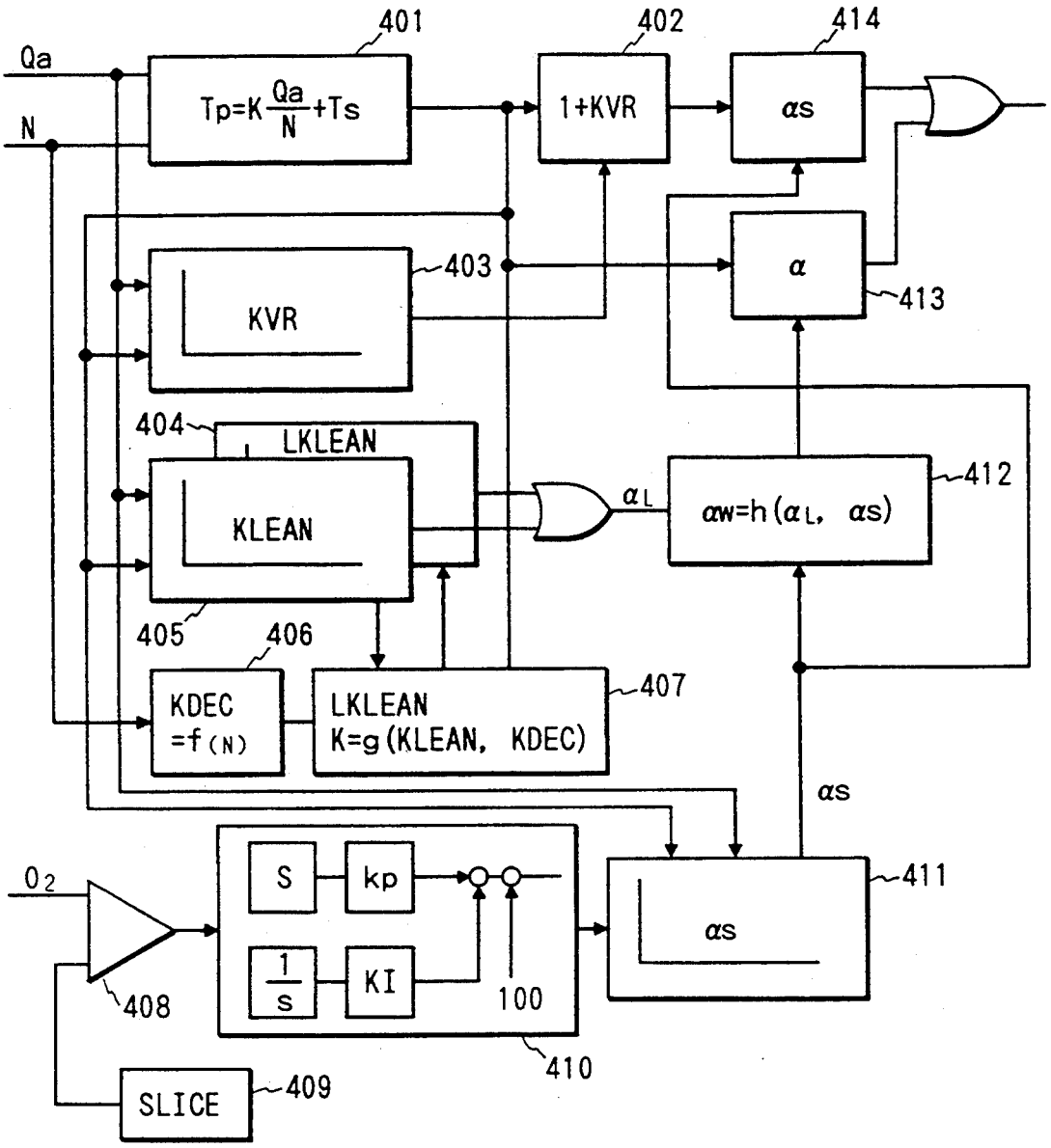
FIG. 4 is a control block diagram of a preferred embodiment of the present invention.

FIG. 4 shows a preferred embodiment of a control logic according to the present invention. Referring to FIG. 4, a basic fuel injection quantity $T_p$ per unit rotational speed of the internal combustion engine is calculated from a suction air quantity $Q_a$ and a rotational speed N of the internal combustion engine in block 401, wherein K represents a fuel injection valve constant, and $T_s$ represents an invalid injection quantity of the fuel injection valve. Block 402 is an air-fuel ratio correcting block, in which KVR represents an air-fuel ratio correction factor. The air-fuel correction factor KVR is retrieved from a map of block 403 according to the suction air quantity $Q_a$ and the engine speed N.

Block 405 is a lean limit air-fuel ratio factor map, and block 404 is a lean limit air-fuel ratio learn factor map. Both blocks 404 and 405 show an air-fuel ratio in a roughness (rotation fluctuation) zone. In block 405, a calculated value of an air-fuel ratio in the condition where rotation fluctuation increases up to a tolerance limit is preliminarily mapped. In block 406, a lean limit is detected from the engine speed N, and a lean limit air-fuel ratio correction factor is calculated. In block 407, the air-fuel ratio learn factor is corrected with use of the calculated correction factor, and is then reflected to the learn map of block 404. While the learn map is usually employed, an OR circuit is preferably provided to select either map always having the factor, so as to avoid that the learn value may not be output.

In block 402, a middle point is obtained from a calculated lean limit air-fuel ratio factor $\alpha_L$ and a calculated theoretical air-fuel ratio factor $\alpha_S$ by using a certain function h. In block 403, a feedback factor $\alpha$ is calculated to perform lean burn control.

Blocks 408, 409, and 410 constitute a theoretical air-fuel ratio feedback logic to perform PI (proportional-+integral) control so that an air-fuel ratio becomes 14.7 according to an output from the oxygen concentration sensor. That is, block 408 as a comparator compares the output from the oxygen concentration sensor with a threshold from block 409, and block 410 as a PI feedback logic calculates a theoretical air-fuel ratio correction factor $\alpha_S$ from an output from the comparator 408. The calculated factor $\alpha_S$ is reflected to a theoretical air-fuel ratio learn map of block 411. In this preferred embodiment, the theoretical air-fuel ratio learn map 411 and the lean limit air-fuel ratio learn map 404 have the axes of a basic fuel injection quantity and an engine speed. As a basic fuel injection quantity indicates an engine load in general, it may be considered that the factor $\alpha_S$ is obtained from the engine load and the engine speed.

Figure 5:
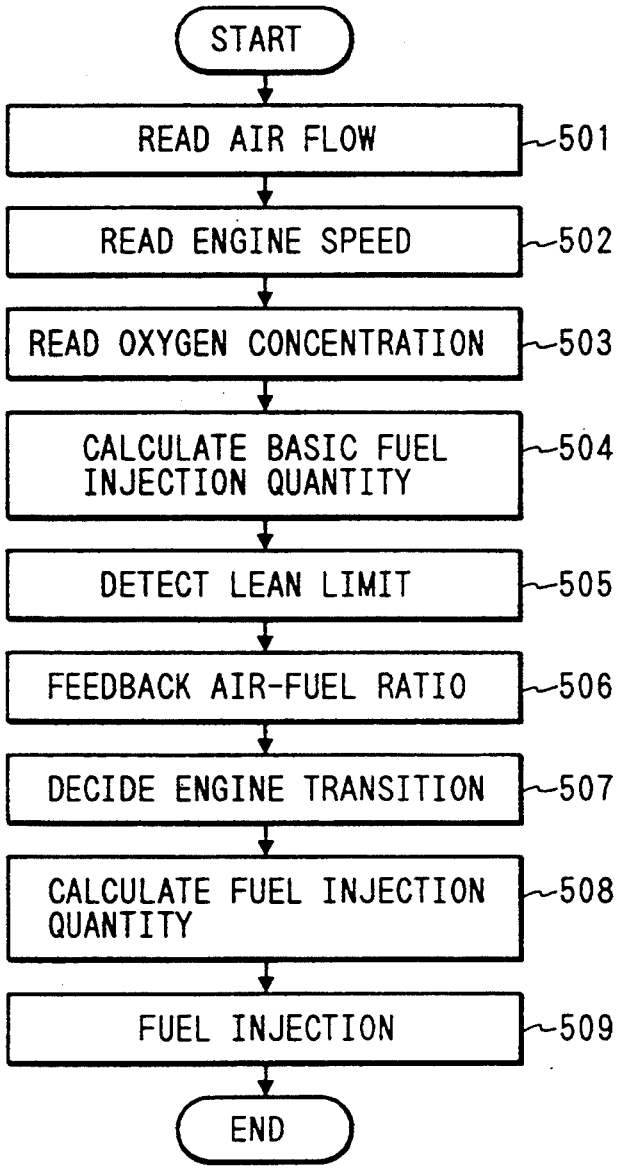
FIG. 5 is a flowchart of a fuel control logic to be performed by the preferred embodiment shown in FIG. 4.

FIG. 5 is a general flowchart of the operation of the internal combustion engine control unit according to the present invention. Referring to FIG. 5, in step 501, an output $Q_a$ from the thermal air flow meter is read by an analog-digital converter or the like in the control unit. In step 502, an engine speed N from the crank angle sensor is similarly read. In step 503, an output $O_2$ from the oxygen concentration sensor is similarly read. Then, in step 504, a basic fuel injection quantity $T_p$ is calculated from the engine speed N and the suction air quantity $Q_a$. In step 505, a lean limit is detected as shown by block 406 in FIG. 4. In block 406, a lean limit air-furl ratio correction factor is also calculated and learned. In step 506, air-fuel ratio feedback is performed according to the output $O_2$ from the oxygen concentration sensor so as to keep a theoretical air-fuel ratio (see blocks 408, 409, and 410 in FIG. 4). In step 507, it is decided whether the internal combustion engine is in a transition state or a steady state according to an output from the throttle opening sensor provided in the suction pipe of the internal combustion engine. In step 508, a fuel injection quantity required by the internal combustion engine is calculated from the air-fuel ratio factor $\alpha_S$, the lean limit air-fuel ratio factor KLEAN, etc. Finally, in step 509, fuel injection is performed.

Figure 6:
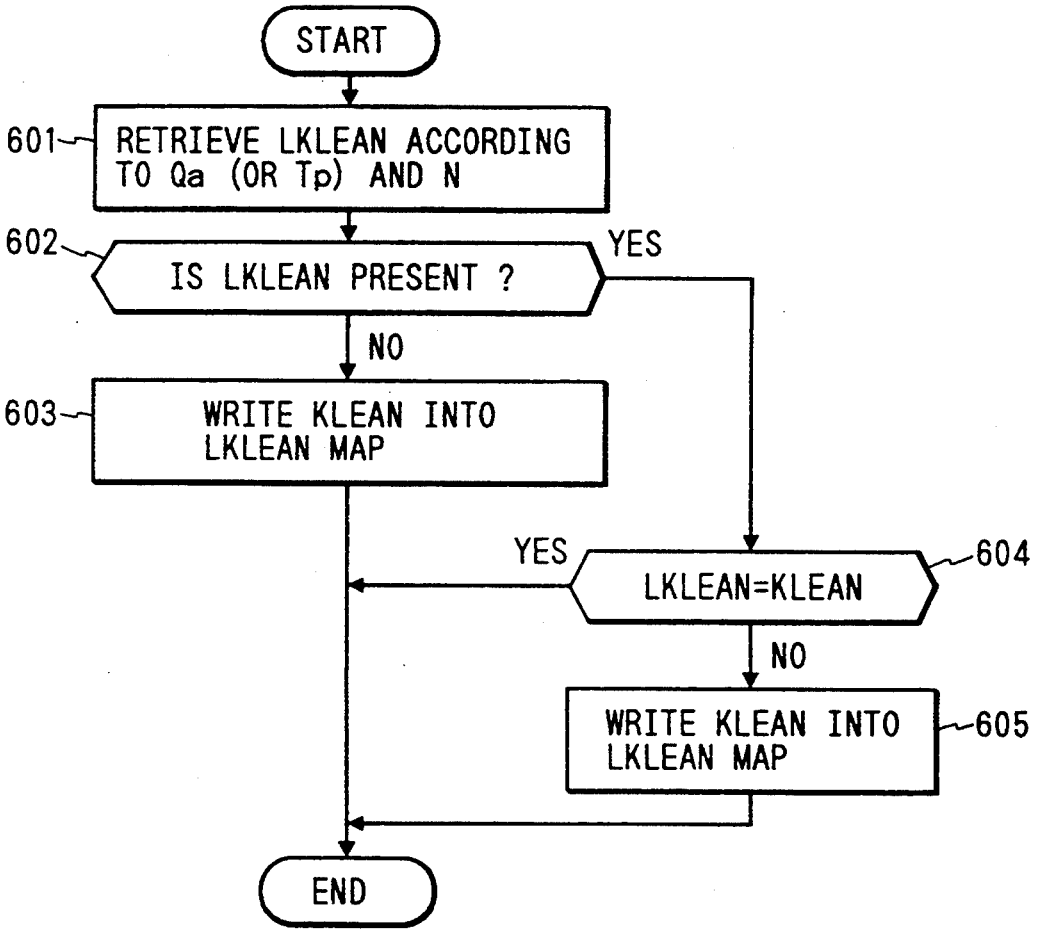
FIG. 6 is a flowchart of a lean limit air-fuel ratio factor learn timing in the preferred embodiment shown in FIG. 4.

FIG. 6 is flowchart showing a learn timing of a lean limit air-fuel ratio factor. Referring to FIG. 6, in step 601, a lean limit air-fuel ratio factor learn value LKLEAN is retrieved from its map according to the engine speed N and the suction air quantity $Q_a$ (or the basic fuel injection quantity $T_p$) (see block 404 in FIG.

4). In step 602, it is decided whether or not the learn value LKLEAN is present in the learn map. If the learn value LKLEAN is not present, a lean limit air-fuel ratio factor KLEAN at this time is written as a learn value into the learn map (step 603). If the learn value LKLEAN is present, it is decided whether or not the learn value LKLEAN is equal to the factor KLEAN at this time (step 604). If the learn value LKLEAN is not equal to the factor KLEAN, the factor KLEAN is written as a learn value into the learn map (step 605).

Figure 7:
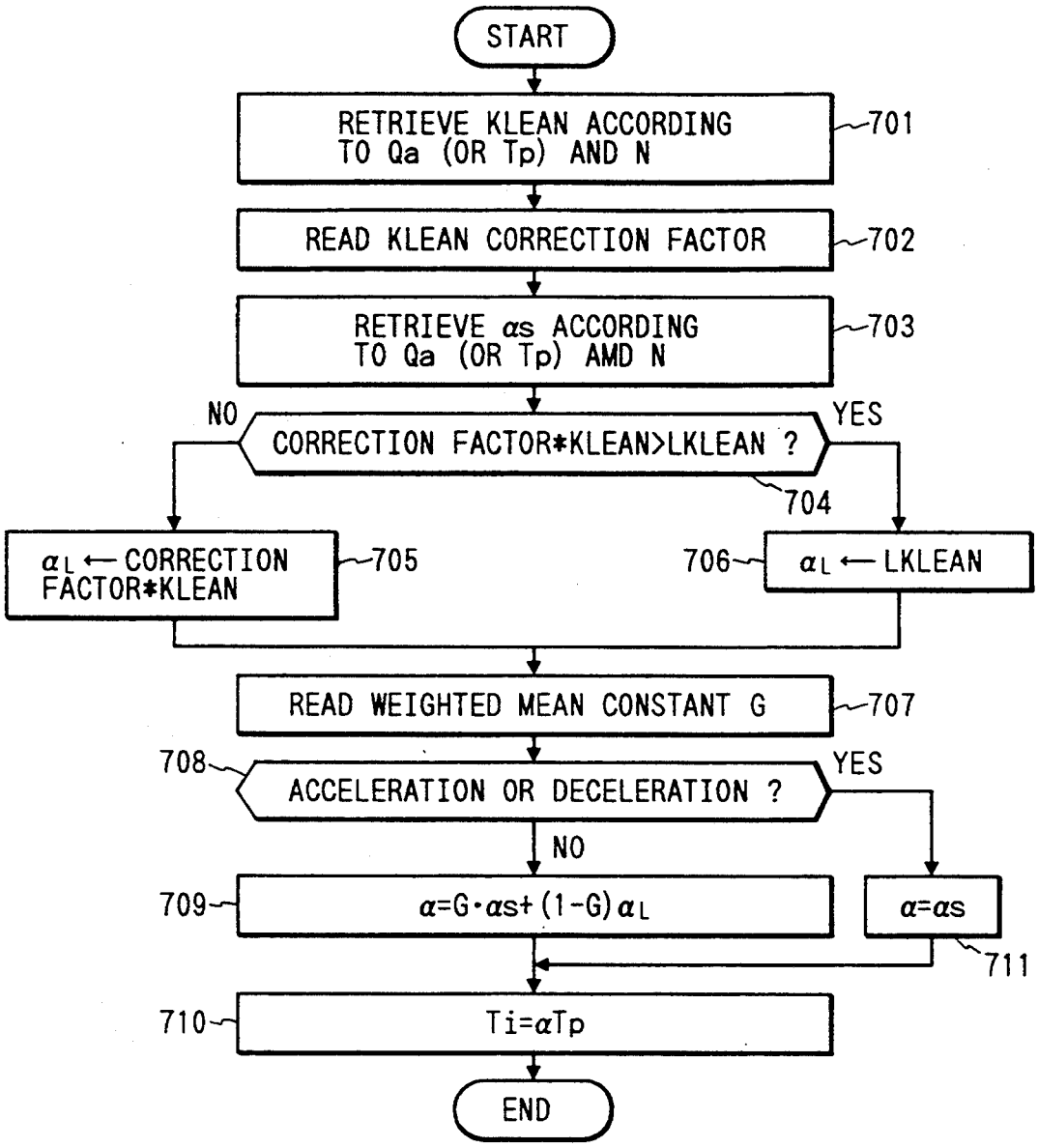
FIG. 7 is a flowchart of lean burn control according to the present invention.

FIG. 7 is a flowchart of fuel control in the lean burn zone by the internal combustion engine control unit according to the present invention. Referring to FIG. 7, in step 701, a lean limit air-fuel ratio factor KLEAN is retrieved from its map according to the engine speed N and the suction air quantity $Q_a$ (or the basic fuel injection quantity $T_p$). In step 702, the lean limit air-fuel ratio correction factor calculated in the above-mentioned logic is read. In step 703, a theoretical air-fuel ratio factor $\alpha_S$ is retrieved from its map according to the engine speed N and the suction air quantity $Q_a$ (or the basic fuel injection quantity $T_p$). In step 704, the product of the lean limit air-fuel ratio correction factor and the lean limit air-fuel ratio factor KLEAN is compared with a lean limit air-fuel ratio factor learn value LKLEAN. If the product of the correction factor and the factor KLEAN is less than the learn value LKLEAN, the factor $\alpha_L$ is set to the product of the correction factor and the factor KLEAN (step 705). On the other hand, if the learn value LKLEAN is less than the product, the factor $\alpha_L$ is set to the learn value LKLEAN (step 706). In step 707, a weighted mean constant G is read. In step 708, it is decided whether the internal combustion engine is in a transition state or a steady state. If the internal combustion engine is in the transition state, the theoretical air-fuel ratio factor $\alpha_S$ is used for the calculation of a fuel injection quantity (steps 711 and 710). On the other hand, if the internal combustion engine is in the steady state, the weighted mean $\alpha$ of the lean limit air-fuel ratio factor $\alpha_L$ and the theoretical air-fuel ratio factor $\alpha_S$ is used for the calculation of a fuel injection quantity (steps 709 and 710).

Figure 8:
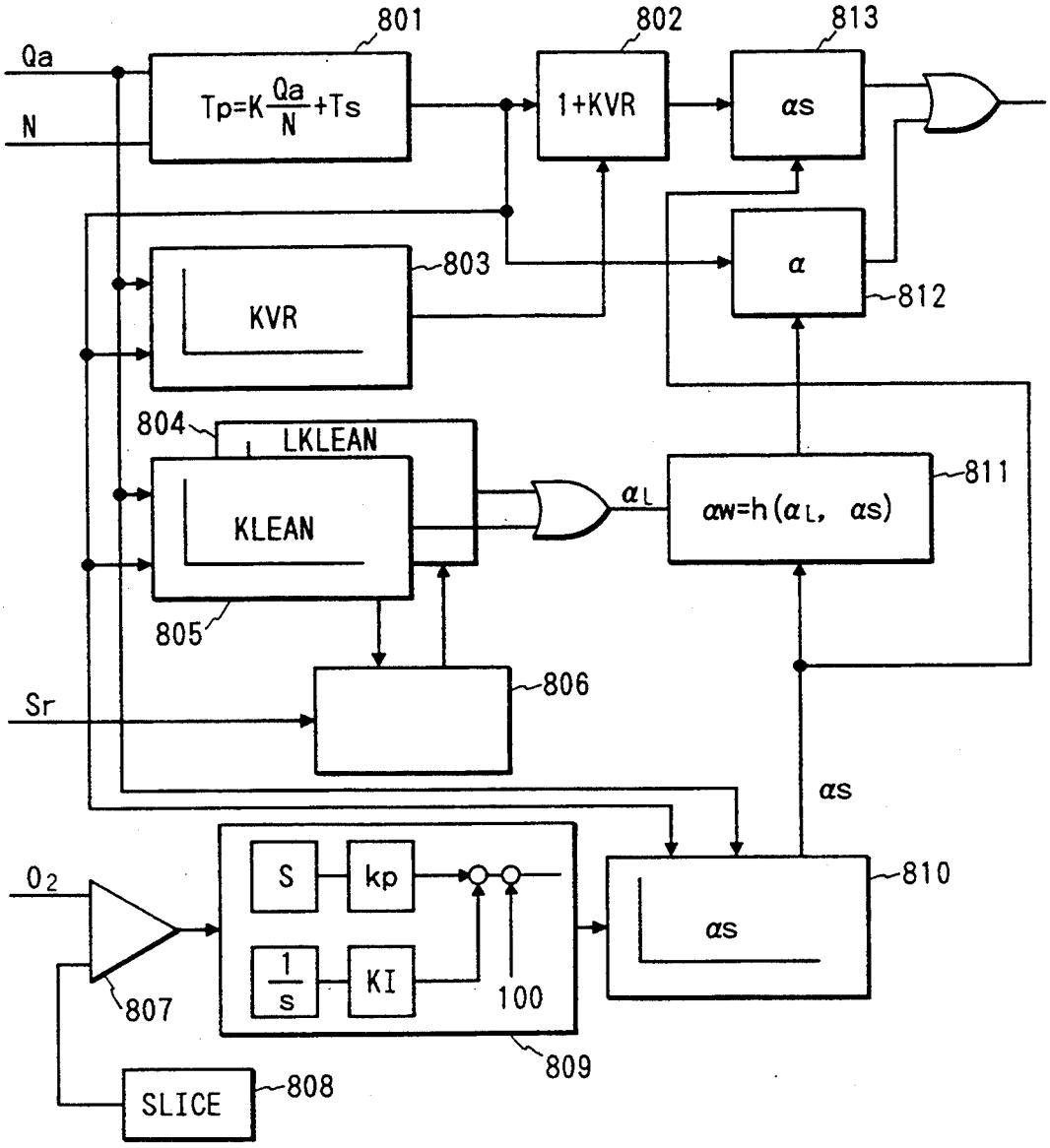
FIG. 8 is a control block diagram similar to FIG. 4, showing another preferred embodiment of the present invention.

FIG. 8 shows a control block diagram according to another preferred embodiment employing an intelligence sensor $S_r$ mounted on the internal combustion engine for generating a lean limit detection signal. The basic construction of the control block in this preferred embodiment is the same as that in the previous preferred embodiment shown in FIG. 4, and the explanation thereof will be omitted herein. Referring to FIG. 8, an output from the intelligence sensor $S_r$ is input into block 806, in which a lean limit air-fuel ratio correction factor is calculated. When rotation fluctuation in the internal combustion engine becomes large, the intelligence sensor $S_r$ outputs a command for somewhat shifting the lean burn zone to the fuel-rich side.

Figure 9:
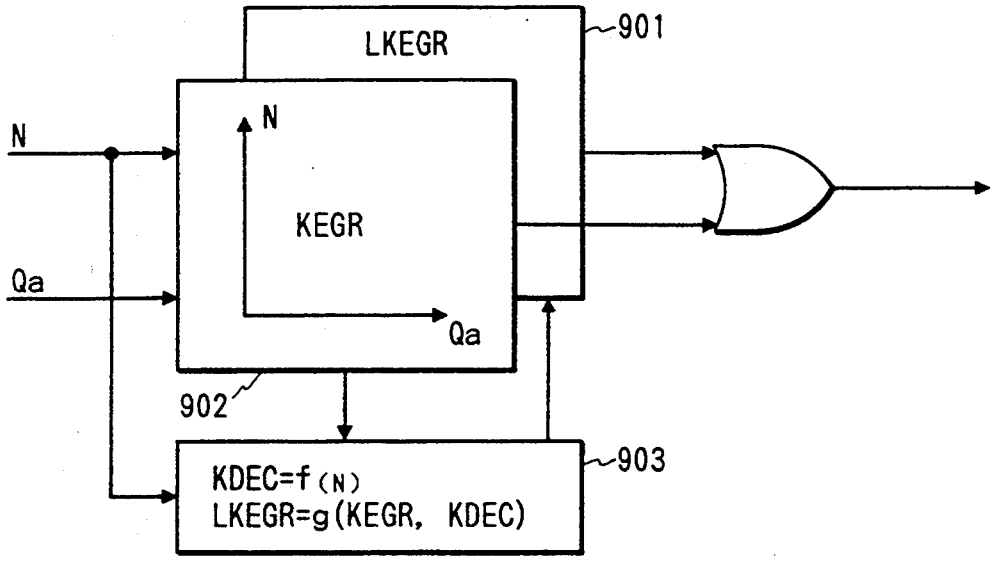
FIG. 9 is a control block diagram of another preferred embodiment in which the lean limit detection is applied to another control.

FIG. 9 shows another preferred embodiment wherein the lean limit detecting block as mentioned above is applied to an electronically controlled exhaust gas recirculation control device (EGR). Referring to FIG. 9, block 902 shows a map of a target exhaust gas recirculation rate KEGR. The map has the axes of an engine speed N and a suction air quantity $Q_a$. Block 901 is a map of a target exhaust gas recirculation rate learn value LKEGR. Block 903 functions to detect a deterioration in burn condition of the internal combustion engine, calculate a target exhaust gas recirculation rate correction factor, correct the target exhaust gas recirculation rate KEGR with use of the correction factor, and write the corrected KEGR as a learn value into the learn map 901.

Figure 10:
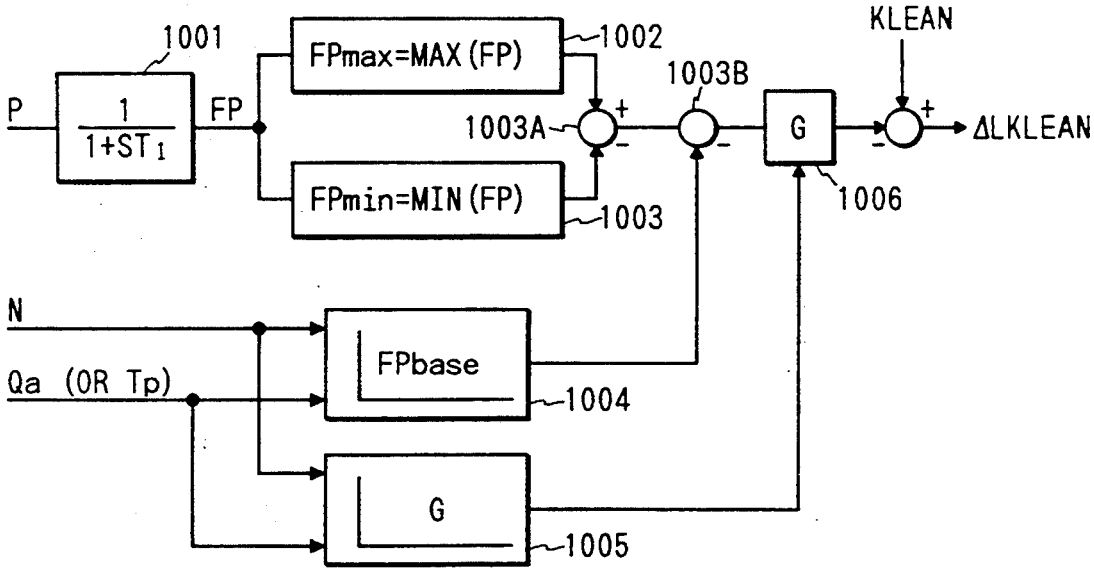
FIG. 10 is a control block diagram of another preferred embodiment using an output from a burning pressure sensor for the detection of a burn condition.

FIG. 10 shows another preferred embodiment employing a burning pressure sensor for the lean limit detection. Referring to FIG. 10, an output signal from the burning pressure sensor (i.e., a pressure P in the cylinder) is input into the internal combustion engine control unit, and is subjected to filtering in block 1001. The maximum value and the minimum value of filtered values over a given interval are detected in blocks 1002 and 1003, respectively. This given interval is determined in synchronism with engine speed or time, and a period fit for the internal combustion engine is selected. In block 1003A, the difference between the maximum value and the minimum value is calculated. A basic value of such a difference is retrieved from a map of block 1004 according to the engine speed N and the suction air quantity $Q_a$ (or the basic fuel injection quantity $T_p$). In block 1003B, the difference between the difference obtained in block 1003A and the basic value retrieved from block 1004 is calculated. The map of block 1004 shows a standard value of the difference between the maximum value and the minimum value of pressures in the cylinder of a general internal combustion engine, which standard value is initially stored as data. This map indicates that when the difference between the maximum value and the minimum value becomes a certain value or more, the air-fuel ratio enters a roughness zone. A gain G is retrieved from a map of block 1005 according to the engine speed N and the suction air quantity $Q_a$ (or the basic fuel injection quantity $T_p$). In block 1006, the gain G retrieved from the map 1005 is multiplied by the difference obtained from block 1003B to correct the lean limit air-fuel ratio factor KLEAN. An output value ΔLKLEAN thus obtained is reflected to the map of the lean limit air-fuel ratio learn factor LKLEAN.

Figure 11:
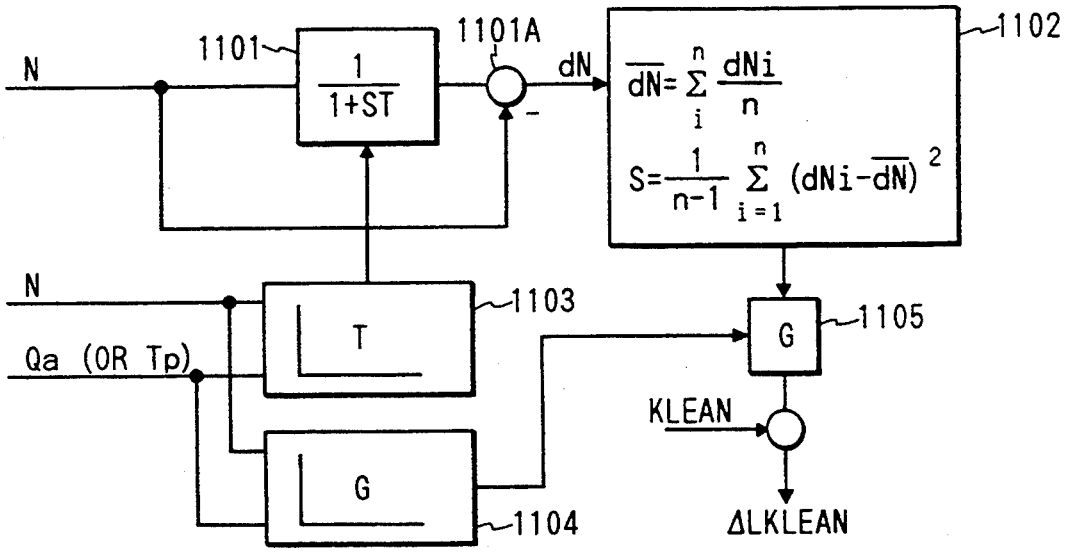
FIG. 11 is a control block diagram of another preferred embodiment using an engine speed for the detection of a burn condition.

FIG. 11 shows another preferred embodiment in which the lean limit detection is performed from a rotational speed of the internal combustion engine. Referring to FIG. 11, the engine speeds N output from the crank angle sensor are subjected to filtering in block 1101. A time constant T is retrieved from a map of block 1103 according to the engine speed N and the suction air quantity $Q_a$ (or the basic fuel injection quantity $T_p$), and the time constant T thus retrieved is used in block 1101. In block 1101A, the differences dN between filtered values and unfiltered values are calculated. Then, in block 1102, the average and the variance S of the differences dN over a given interval are calculated. A gain G is retrieved from a map of block 1104 according to the engine speed N and the suction air quantity $Q_a$ (or the basic fuel injection quantity $T_p$). Then, in block 1105, the gain G thus retrieved from the map 1104 is multiplied by the variance S calculated in block 1102 to correct the lean limit air-fuel ratio factor KLEAN. An output value ΔLKLEAN thus obtained is reflected to the map of the lean limit air-fuel ratio learn factor LKLEAN.

In this manner, the average and the variance of rotation fluctuations over a given interval are calculated, and it is decided that the larger the variance, the larger the rotation fluctuations. In accordance with the increase in the variance, the air-fuel ratio in the roughness zone is corrected.

Figure 12:
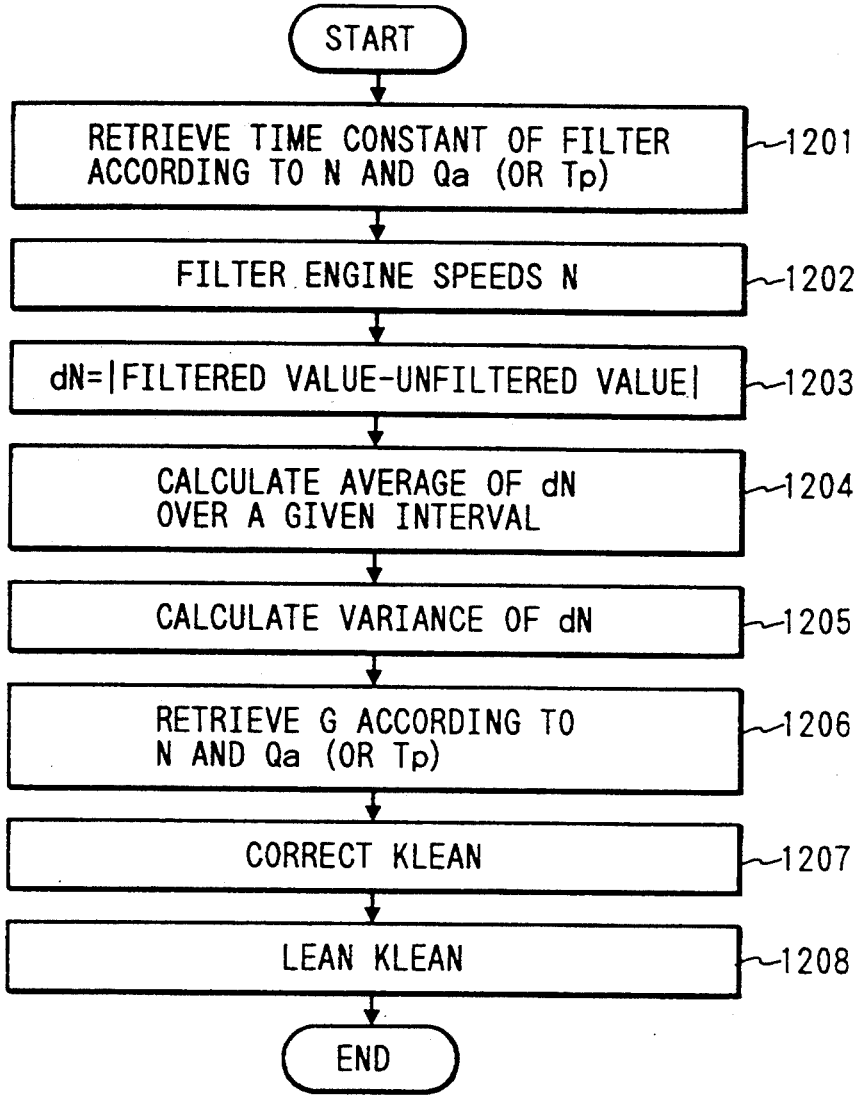
FIG. 12 is a flowchart of lean limit detection according to the preferred embodiment shown in FIG. 11.

FIG. 12 is a flowchart illustrating the lean limit detection, the calculation and the learning of the lean limit air-fuel ratio correction factor according to the preferred embodiment shown in FIG. 11. Referring to FIG. 12, in step 1201, the time constant T of the filter is retrieved from the map (see block 1104 in FIG. 11) having the axes of an engine speed N and a suction air quantity $Q_a$ (or a basic fuel injection quantity $T_p$). In step 1202, the engine speeds N are filtered by using the time constant T retrieved above. In step 1203, the absolute values dN of the differences between filtered values and unfiltered values are calculated. In step 1204, the average of the absolute values dN over a given interval is calculated. In step 1205, the variance S of the differences dN is calculated by using the average calculated in step 1204. In step 1206, the correction gain G is retrieved from the map (see block 1104 in FIG. 11) having the axes of an engine speed N and a suction air quantity $Q_a$ (or a basic fuel injection quantity $T_p$). In step 1207, the lean limit air-fuel ratio factor KLEAN is corrected by using the gain G, and in step 1208, the corrected value of the factor KLEAN is written as a learn value into the map of the lean limit air-fuel ratio learn factor LKLEAN.

FIG. 13 shows another preferred embodiment similar to the preferred embodiment shown in FIG. 11, in which the lean limit detection is performed from a rotational speed of the internal combustion engine, and more particularly, a change in rotation angular velocity is detected. Referring to FIG. 13, block 1301 shows a sampler for sampling the engine speeds N. The sampling is performed in synchronism with engine speed or time. In block 1302, the average of the engine speeds N over a given interval is calculated. In block 1302A, the differences dN between the sampled engine speeds N and the average is calculated. In block 1303, the differences ΔdN between the differences dN and similar differences before the given interval are calculated. A threshold (SLICE) is retrieved from a map of block 1304 according to the engine speed N and the suction air quantity $Q_a$ (or the basic fuel injection quantity $T_p$). In block 1305 as a comparator having a hysteresis, the differences ΔdN calculated above are compared with the threshold retrieved from the map 1304 to detect a lean limit.

In this manner, the differences between the sampled engine speeds and the average thereof over a given interval are calculated. That is, variations from a central value are calculated. Then, the differences between the differences over the present given interval and the differences over the previous given interval are calculated. That is, differential values are calculated. Then, the roughness zone can be decided by determining a degree of change in the differential values.

FIG. 14 shows a timing chart of the lean limit detection according to the preferred embodiment shown in FIG. 13. Referring to FIG. 14, chart 1401 shows rotation fluctuations of the internal combustion engine. The left-hand portion of the chart 1401 shows the rotation fluctuations during normal rotation of the internal combustion engine (near the theoretical air-fuel ratio), and the right-hand portion of the chart 1401 shows the rotation fluctuations at the lean limit (the roughness zone). Chart 1402 shows the differences dN, or the variations from the central value, and chart 1403 shows the differences ΔdN between the differences dN over the present given interval and the differences dN over the previous given interval.

As understood from FIG. 14, when the air-fuel ratio enters the roughness zone, a change in the variations dN from the central value becomes large. Further, when any of the differential values ΔdN exceed the threshold (SLICE), a lean limit detection signal J indicating that the air-fuel ratio has entered the roughness zone is output as shown in chart 1404.

Figure 15:
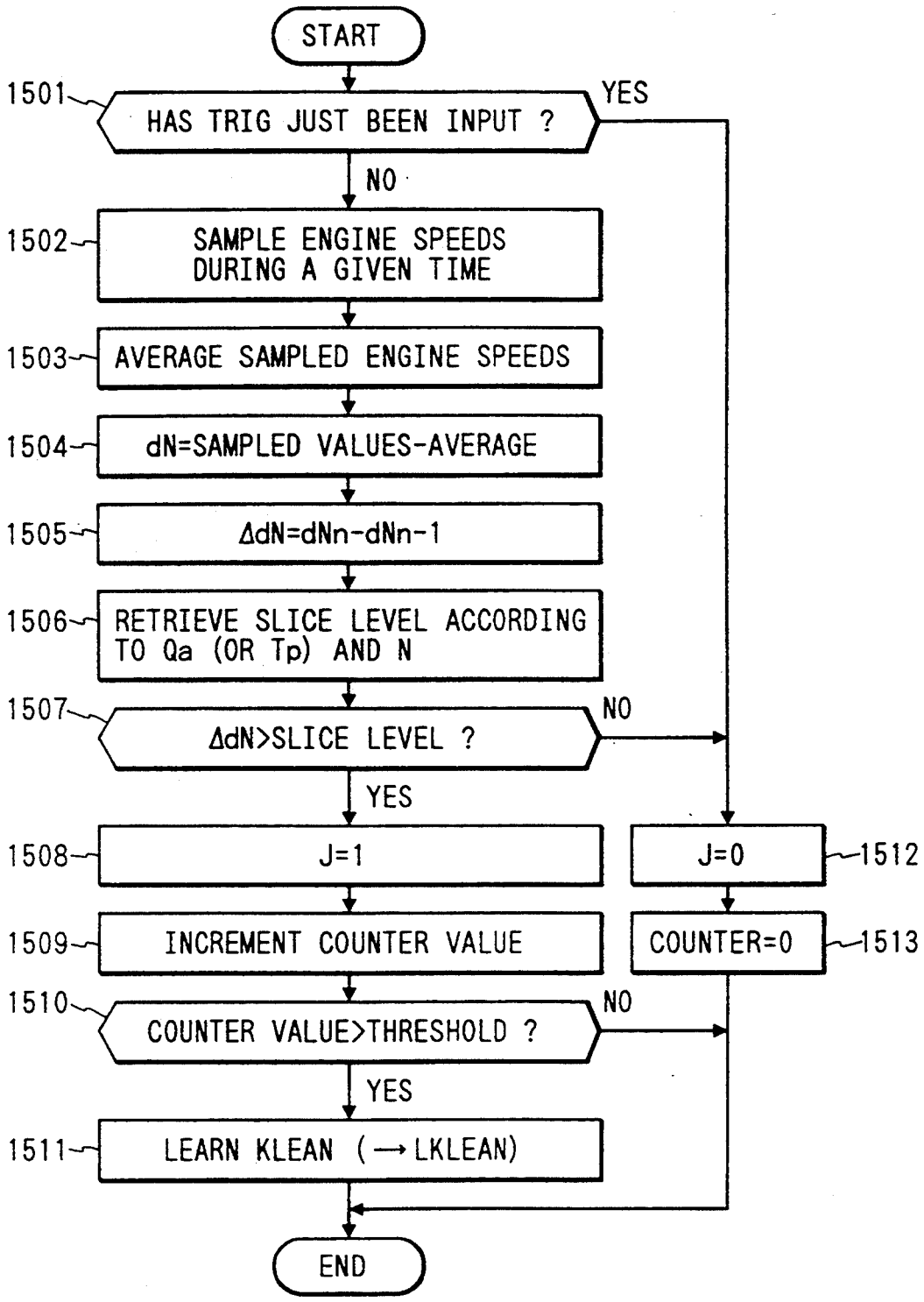
FIG. 15 is a flowchart of lean limit detection according to the preferred embodiment shown in FIG. 13.

FIG. 15 is a flowchart illustrating the lean limit detection according to the preferred embodiment shown in FIG. 13. Referring to FIG. 15, in step 1501, it is decided whether or not a starting period TRIG generating a given interval has been input. This given interval is input in synchronism with time, engine speed, external interruption, etc. If the starting period TRIG has just input, a lean limit detection signal is initialized in step 1512, and a lean limit decision counter is initialized in step 1513. If the starting period TRIG has not just been input, the engine speeds N are sampled during every given time in step 1502, and the engine speeds N thus sampled are averaged in step 1503. In step 1504, the average obtained in step 1503 is subtracted from the sampled engine speeds to calculate the differences dN. In step 1505, the differences $dN_{n-1}$ during the previous given time are subtracted from the differences $dN_n$ during the present given time to calculate the changes ΔdN per unit time. In step 1506, the threshold is retrieved from the map (see block 1304 in FIG. 13) according to the engine speed N and the suction air quantity $Q_a$ (or the basic fuel injection quantity $T_p$). Then, in step 1507, it is decided whether or not any of the changes ΔdN exceed the threshold. If the answer in step 1507 is YES, the lean limit detection signal (J=1) is output (step 1508), and the count value of the lean limit decision counter is incremented (step 1509). In step 1510, it is decided whether or not the count value exceeds a threshold. If the answer in step 1510 is YES, the lean limit air-fuel ratio factor KLEAN is learned in step 1511. If the answer in step 1507 is NO, the lean limit detection signal and the lean limit decision counter are initialized in steps 1512 and 1513, respectively.

FIG. 16 shows another preferred embodiment wherein the lean limit detection is performed from a natural frequency of the internal combustion engine. Referring to FIG. 16, a signal Kf denotes an output from an oscillation sensor mounted on the internal combustion engine. A natural frequency Kfs is extracted from this output Kf by a band pass filter in block 1601. The natural frequency Kfs is integrated over a given interval in block 1602. A threshold (SLICE) is retrieved from a map of block 1603 according to the engine speed N and the suction air quantity $Q_a$ (or the basic fuel injection quantity $T_p$). Then, in block 1604 as a comparator, an integral value output from block 1602 is compared with the threshold retrieved from the map 1603. If the integral value exceeds the threshold, a lean limit detection signal J is output from the comparator 1604.

In this manner, the roughness zone is decided by determining whether or not the integral value of oscillation over a given interval has exceeded the threshold.

FIG. 17 shows a timing chart of the lean limit detection according to the preferred embodiment shown in FIG. 16. Referring to FIG. 17, chart 1701 shows the output signal Kf from the oscillation sensor; chart 1702 shows the filtered value Kfs of the output signal Kf; and chart 1703 shows the lean limit detection signal.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

For example, while the internal combustion engine control unit of the preferred embodiment shown in FIG. 2 is constructed of a digital computing device, it may be constructed of an analog computing device.

Further, while the filter for processing the signal from the burning pressure sensor according to the preferred embodiments shown in FIGS. 10 and 11 is a first-order lag filter in a continuous region, it may be a digital filter in a discrete region.

As understood from the above description, a burning condition of the internal combustion engine is detected according to the present invention, so that a deterioration in lean burn condition due to a timewise change of the internal combustion engine can be avoided. Further, since lean burn control is performed at the middle point between an air-fuel ratio factor from the burn condition detecting means and a theoretical air-fuel ratio factor, a deterioration in exhaust gas emission can be avoided, and a stable output torque of the internal combustion engine can be expected. Further, since either a lean burn condition or a theoretical air-fuel ratio condition of the internal combustion engine can be selected, a fuel consumption can be improved without damaging a vehicle running condition.

What is claimed is:

1. A lean burn control device for an internal combustion engine, comprising:

means for detecting a burn condition of said internal combustion engine;

means for computing an internal condition variable representing a burn degree from an output from said means for detecting said burn condition;

an oxygen concentration sensor provided in an exhaust pipe of said internal combustion engine for detecting an oxygen concentration in an exhaust gas;

means for computing a first fuel quantity to be supplied to said internal combustion engine according to an output from said oxygen concentration sensor to control an air-fuel ratio to a theoretical air-fuel ratio;

means for computing a second fuel quantity to be supplied to said internal combustion engine according to said internal condition variable representing said burn degree and an internal condition variable representing said theoretical air-fuel ratio;

means for detecting one of a transition state and a steady state of said internal combustion engine;

means for selecting one of said first fuel quantity and said second fuel quantity according to an output from said means for detecting one of said transition state and said steady state;

means for detecting a rotational speed of said internal combustion engine; and means for detecting an air quantity to be sucked into said internal combustion engine.

2. A lean burn control device for an internal combustion engine according to claim 1, wherein said means for detecting said burn condition of said internal combustion engine comprises a burning pressure sensor mounted in a combustion chamber of said internal combustion engine.

3. A lean burn control device for an internal combustion engine according to claim 1, wherein said means for detecting said burn condition of said internal combustion engine comprises means for detecting a rotation fluctuation of said internal combustion engine.

4. A lean burn control device for an internal combustion engine according to claim 1, wherein said means for detecting said burn condition of said internal combustion engine comprises means for detecting a natural frequency of combustion of said internal combustion engine.

5. A lean burn control device for an internal combustion engine according to claim 1, wherein said means for detecting said burn condition of said internal combustion engine comprises means for detecting a frequency of light generated by combustion in said internal combustion engine.

6. A lean burn control device for an internal combustion engine according to claim 1, wherein said oxygen concentration sensor for detecting said oxygen concentration in said exhaust gas comprises a sensor adapted to output a binary signal with respect to a threshold of said air-fuel ratio.

7. A lean burn control device for an internal combustion engine according to claim 1, wherein said oxygen concentration sensor for detecting said oxygen concentration in said exhaust gas comprises a sensor adapted to output a linear signal with respect to said air-fuel ratio.

8. A lean burn control device for an internal combustion engine according to claim 1, wherein said means for detecting one of said transition state and said steady state of said internal combustion engine comprises means for detecting a change in output from a throttle opening sensor provided in a suction pipe of said internal combustion engine.

9. A lean burn control device for an internal combustion engine according to claim 1, wherein said means for detecting one of said transition state and said steady state of said internal combustion engine comprises means for detecting a change in said rotational speed of said internal combustion engine.

10. A lean burn control device for an internal combustion engine according to claim 1, wherein said means for detecting one of said transition state and said steady state of said internal combustion engine comprises means for detecting a change in said air quantity to be sucked into said internal combustion engine.

11. A lean burn control device for an internal combustion engine according to claim 1, wherein said means for detecting said air quantity to be sucked into said internal combustion engine comprises a thermal air flow meter.

12. A lean burn control device for an internal combustion engine, comprising:

a lean burn limit map preliminarily stored;

an oxygen concentration sensor provided in an exhaust pipe of said internal combustion engine for detecting an oxygen concentration in an exhaust gas;

means for computing a first fuel quantity to be supplied to said internal combustion engine according to an output from said oxygen concentration sensor to control an air-fuel ratio to a theoretical air-fuel ratio;

means for computing a second fuel quantity to be supplied to said internal combustion engine according to a constant retrieved from said lean burn limit map according to a condition of said internal combustion engine and an internal condition variable representing said theoretical air-fuel ratio;

means for detecting one of a transition state and a steady state of said internal combustion engine;

means for selecting one of said first fuel quantity and said second fuel quantity according to an output from said means for detecting one of said transition state and said steady state;

means for detecting a rotational speed of said internal combustion engine; and means for detecting an air quantity to be sucked into said internal combustion engine.

13. A lean burn control device for an internal combustion engine according to claim 12, wherein said lean burn limit map comprises a function of an output from said means for detecting said rotational speed of said internal combustion engine and an output from said means for detecting said air quantity to be sucked into said internal combustion engine.

14. A fuel injection quantity control device for an internal combustion engine, comprising:

means for detecting a burn condition of said internal combustion engine;

means for computing an internal condition variable representing a burn degree from an output from said means for detecting said burn condition;

an oxygen concentration sensor provided in an exhaust pipe of said internal combustion engine for detecting an oxygen concentration in an exhaust gas;

means for computing a first fuel quantity to be supplied to said internal combustion engine according to an output from said oxygen concentration sensor to control an air-fuel ratio to a theoretical air-fuel ratio;

means for computing a second fuel quantity to be supplied to said internal combustion engine according to said internal condition variable representing said burn degree and an internal condition variable representing said theoretical air-fuel ratio;

means for detecting one of a transition state and a steady state of said internal combustion engine;

means for selecting one of said first fuel quantity and said second fuel quantity according to an output from said means for detecting one of said transition state and said steady state;

means for detecting a rotational speed of said internal combustion engine;

means for detecting an air quantity to be sucked into said internal combustion engine;

a fuel injector; and means for computing a fuel injection quantity to be injected from said fuel injector into said internal combustion engine according to an output from said means for detecting said rotational speed of said internal combustion engine and an output from said means for detecting said air quantity to be sucked into said internal combustion engine.

15. A fuel injection quantity control device for an internal combustion engine, comprising:

a lean burn limit map preliminarily stored;

an oxygen concentration sensor provided in an exhaust pipe of said internal combustion engine for detecting an oxygen concentration in an exhaust gas;

means for computing a first fuel quantity to be supplied to said internal combustion engine according to an output from said oxygen concentration sensor to control an air-fuel ratio to a theoretical air-fuel ratio;

means for computing a second fuel quantity to be supplied to said internal combustion engine according to a constant retrieved from said lean burn limit map according to a condition of said internal combustion engine and an internal condition variable representing said theoretical air-fuel ratio;

means for detecting one of a transition state and a steady state of said internal combustion engine;

means for selecting one of said first fuel quantity and said second fuel quantity according to an output from said means for detecting one of said transition state and said steady state;

means for detecting a rotational speed of said internal combustion engine;

means for detecting an air quantity to be sucked into said internal combustion engine;

a fuel injector; and means for computing a fuel injection quantity to be injected from said fuel injector into said internal combustion engine according to an output from said means for detecting said rotational speed of said internal combustion engine and an output from said means for detecting said air quantity to be sucked into said internal combustion engine.

16. A lean burn control method for an internal combustion engine, comprising the steps of:

detecting a burn condition of said internal combustion engine;

computing an internal condition variable representing a burn degree from a result of detection in said step of detecting said burn condition;

detecting an oxygen concentration in an exhaust gas;

computing a first fuel quantity to be supplied to said internal combustion engine according to a result of detection in said step of detecting said oxygen concentration to control an air-fuel ratio to a theoretical air-fuel ratio;

computing a second fuel quantity to be supplied to said internal combustion engine according to said internal condition variable representing said burn degree and an internal condition variable representing said theoretical air-fuel ratio;

detecting one of a transition state and a steady state of said internal combustion engine;

selecting one of said first fuel quantity and said second fuel quantity according to a result of detection in said step of detecting one of said transition state and said steady state;

detecting a rotational speed of said internal combustion engine; and detecting an air quantity to be sucked into said internal combustion engine.

17. A lean burn control method for an internal combustion engine according to claim 16, wherein said step of detecting said burn condition of said internal combustion engine comprises a step of detecting a rotation fluctuation of said internal combustion engine.

18. A lean burn control method for an internal combustion engine according to claim 16, wherein said step of detecting said burn condition of said internal combustion engine comprises a step of detecting a natural frequency of combustion of said internal combustion engine.

19. A lean burn control method for an internal combustion engine according to claim 16, wherein said step of detecting said burn condition of said internal combustion engine comprises a step of detecting a frequency of light generated by combustion in said internal combustion engine.

20. A lean burn control method for an internal combustion engine according to claim 16, wherein said step of detecting said oxygen concentration in said exhaust gas comprises a step of outputting a binary signal with respect to a threshold of said air-fuel ratio.

21. A lean burn control method for an internal combustion engine according to claim 16, wherein said step of detecting said oxygen concentration in said exhaust gas comprises a step of outputting a linear signal with respect to said air-fuel ratio.

22. A lean burn control method for an internal combustion engine according to claim 16, wherein said step of detecting one of said transition state and said steady state of said internal combustion engine comprises a step of detecting a change in said rotational speed of said internal combustion engine.

23. A lean burn control method for an internal combustion engine according to claim 16, wherein said step of detecting one of said transition state and said steady state of said internal combustion engine comprises a step of detecting a change in said air quantity to be sucked into said internal combustion engine.

24. A lean burn control method for an internal combustion engine, comprising the steps of:

detecting an oxygen concentration in an exhaust gas;

computing a first fuel quantity to be supplied to said internal combustion engine according to a result of detection in said step of detecting said oxygen concentration to control an air-fuel ratio to a theoretical air-fuel ratio;

computing a second fuel quantity to be supplied to said internal combustion engine according to a constant retrieved from a lean burn limit map preliminarily stored according to a condition of said internal combustion engine and an internal condition variable representing said theoretical air-fuel ratio;

detecting one of a transition state and a steady state of said internal combustion engine;

selecting one of said first fuel quantity and said second fuel quantity according to a result of detection in said step of detecting one of said transition state and said steady state;

detecting a rotational speed of said internal combustion engine; and detecting an air quantity to be sucked into said internal combustion engine.

25. A fuel injection quantity control method for an internal combustion engine, comprising the steps of:

detecting a burn condition of said internal combustion engine;

computing an internal condition variable representing a burn degree from a result of detection in said step of detecting said burn condition;

detecting an oxygen concentration in an exhaust gas;

computing a first fuel quantity to be supplied to said internal combustion engine according to a result of detection in said step of detecting said oxygen concentration to control an air-fuel ratio to a theoretical air-fuel ratio;

computing a second fuel quantity to be supplied to said internal combustion engine according to said internal condition variable representing said burn degree and an internal condition variable representing said theoretical air-fuel ratio;

detecting one of a transition state and a steady state of said internal combustion engine;

selecting one of said first fuel quantity and said second fuel quantity according to a result of detection in said step of detecting one of said transition state and said steady state;

detecting a rotational speed of said internal combustion engine;

detecting an air quantity to be sucked into said internal combustion engine; and computing a fuel injection quantity to be injected from a fuel injector into said internal combustion engine according to a result of detection in said step of detecting said rotational speed of said internal combustion engine and a result of detection in said step of detecting said air quantity to be sucked into said internal combustion engine.

26. A lean burn control method for an internal combustion engine, comprising the steps of:

detecting an oxygen concentration in an exhaust gas;

computing a first fuel quantity to be supplied to said internal combustion engine according to a result of detection in said step of detecting said oxygen concentration to control an air-fuel ratio to a theoretical air-fuel ratio;

computing a second fuel quantity to be supplied to said internal combustion engine according to a constant retrieved from a lean burn limit map preliminarily stored according to a condition of said internal combustion engine and an internal condition variable representing said theoretical air-fuel ratio;

detecting one of a transition state and a steady state of said internal combustion engine;

selecting one of said first fuel quantity and said second fuel quantity according to a result of detection in said step of detecting one of said transition state and said steady state;

detecting a rotational speed of said internal combustion engine;

detecting an air quantity to be sucked into said internal combustion engine; and computing a fuel injection quantity to be injected from a fuel injector into said internal combustion engine according to a result of detection in said step of detecting said rotational speed of said internal combustion engine and a result of detection in said step of detecting said air quantity to be sucked into said internal combustion engine.

* * * * *